US006749754B1

(12) United States Patent
Holder et al.

(10) Patent No.: US 6,749,754 B1
(45) Date of Patent: Jun. 15, 2004

(54) METHOD FOR DESULPHURIZING ENGINE FUEL ON BOARD A MOTOR VEHICLE

(75) Inventors: Eberhard Holder, Kusterdingen (DE); Roland Kemmler, Stuttgart (DE); Martin Matt, Bruchsal (DE); Viktor Pfeffer, Ostfildern (DE); Carsten Plog, Markdorf (DE); Thomas Stengel, Friedrichshafen (DE); Ralph Stetter, Remshalden (DE); Karl-Heinz Thiemann, Korb (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/806,465

(22) PCT Filed: Oct. 1, 1999

(86) PCT No.: PCT/EP99/07267

§ 371 (c)(1),
(2), (4) Date: Jun. 28, 2001

(87) PCT Pub. No.: WO00/20531

PCT Pub. Date: Apr. 13, 2000

(30) Foreign Application Priority Data

Oct. 2, 1998 (DE) ..... 198 45 397

(51) Int. Cl.[7] ..... C02F 3/00; C10G 29/00; B01J 49/00

(52) U.S. Cl. ..... 210/601; 210/670; 210/679; 210/241; 210/902; 208/246

(58) Field of Search ..... 210/616–618, 210/670, 671, 679, 680, 902, 607, 601; 208/246, 250

(56) References Cited

U.S. PATENT DOCUMENTS

| | | | | | |
|---|---|---|---|---|---|
| 3,616,375 | A | * | 10/1971 | Inoue | 204/157.15 |
| 3,971,712 | A | * | 7/1976 | Miller | 208/208 R |
| 4,039,130 | A | * | 8/1977 | Hogan | |
| 4,259,213 | A | * | 3/1981 | Bishop, III | 502/415 |
| 4,419,273 | A | | 12/1983 | Santilli et al. | 502/80 |
| 4,419,968 | A | * | 12/1983 | Lee | 123/3 |
| 4,738,771 | A | * | 4/1988 | Miller et al. | 208/135 |
| 5,057,473 | A | * | 10/1991 | Voecks et al. | 502/73 |
| 5,146,036 | A | * | 9/1992 | Hovis | 585/709 |
| 5,146,039 | A | * | 9/1992 | Wildt et al. | 208/310 Z |
| 5,360,536 | A | * | 11/1994 | Nemeth et al. | 208/226 |
| 6,129,835 | A | * | 10/2000 | Lesieur et al. | 208/208 R |
| 6,130,081 | A | * | 10/2000 | Konishi et al. | 435/252.1 |
| 6,156,084 | A | * | 12/2000 | Bonville et al. | 48/61 |
| 6,235,519 | B1 | * | 5/2001 | Wang et al. | 435/189 |
| 6,271,173 | B1 | * | 8/2001 | Khare | 502/400 |
| 6,293,094 | B1 | * | 9/2001 | Schmidt et al. | 60/284 |
| 6,461,859 | B1 | * | 10/2002 | Duhalt et al. | 435/282 |
| 6,530,216 | B2 | * | 3/2003 | Pott | 60/295 |
| 2002/0043484 | A1 | * | 4/2002 | Khare | 208/244 |

FOREIGN PATENT DOCUMENTS

| | | | | |
|---|---|---|---|---|
| DE | 3733321 | A1 * | 4/1989 | B63B/35/44 |
| DE | 196 52 681 | | 4/1998 | |
| DE | 198 17 758 | | 4/1998 | |

* cited by examiner

*Primary Examiner*—Chester T Barry
(74) *Attorney, Agent, or Firm*—Crowell & Moring LLP

(57) ABSTRACT

A process for the desulfurization of an engine fuel onboard a motor vehicle includes separating sulfur-containing components of the engine fuel by selective liquid-phase adsorption on an adsorption material. The adsorption material may be an oxide of Al, Mg, Si, or Ti that is doped with Ag.

33 Claims, 5 Drawing Sheets

METHOD FOR DESULPHURIZING ENGINE FUEL ON BOARD A MOTOR VEHICLE

BACKGROUND AND SUMMARY OF INVENTION

The invention relates to a process for the desulfurization of an engine fuel onboard a rotor vehicle.

The desulfurization of engine fuel is usually carried out using large-scale chemical processes in refineries during production of the fuel. Processes which are known for this purpose include extraction, adsorption (e.g. U.S. Pat. No. 5,360,536), distillation or microbiological processes. Commercially available engine fuels in Europe currently have a residual sulphur content of approximately 200 ppm. This causes problems with regard to the sulphur compatibility of modern exhaust-gas after-treatment systems, which include adsorbers and catalytic converters. Therefore, residual sulphur contents of less than 10 ppm are desired.

It is an object of the invention to provide a process for separating off sulphur-containing components from an engine fuel which is suitable for use in mobile systems. In particular, only a small overall volume and a low weight should be required in order to implement this process.

This object is achieved by the process according to the present invention. Advantageous embodiments of the invention form the subject matter of further claims.

According to the invention, the desulfurization of the fuel takes place onboard the motor vehicle by selectively separating off the sulphur-containing fuel components by means of liquid-phase adsorption. To do this, an adsorption material which selectively adsorbs substantially only the sulphur-containing fuel components is used.

The adsorption means used is in particular solids with a high surface area (in particular in the range from 10 to 1600 $m^{-1}/g$), primarily substances of this type which contain Al, Mg, Si or Ti in oxide form. Examples of these substances are $Al_2O_4$, MgO, SiO, TiO, zeolites, hydrotalcites or mixed oxides. It is also possible to use the said substances doped with a metal, such as for example an alkali metal, an alkaline-earth metal, a rare earth, or Ag, Cu, Co, Fe, Mn, Ni, V or Zn. Biogenic materials, such as for example enzymes, can also be used. Furthermore, it is possible to convert the sulphur contained in the fuel into other sulphur compounds by means of microorganisms which are brought into contact with the fuel.

The adsorption material has a temporally limited separating capacity and has to be replaced after a period of time as part of the regular servicing of the vehicle. In an alternative embodiment, however, the adsorption material can also be regenerated onboard the motor vehicle, in particular by heat treatment. The regeneration can advantageously be carried out by temperature control by means of the coolant circuit (approx. 80° C.) or engine oil circuit (>100° C.) which is present in the vehicle.

In an advantageous embodiment, adsorption device and fuel filter can be integrated in a single structural unit. In this case, adsorption material and the material for the fuel filtering may, for example, be arranged or layered immediately next to or on top of one another.

By using the low-sulphur fuel obtained, it is possible to significantly prolong the service life of modern exhaust-gas after-treatment systems.

The low-sulphur fuel is particularly suitable for being added when a spark-ignition engine is operating in lean-burn mode.

In the case of a diesel engine, the particle emissions in the exhaust gas can be reduced by the addition of low-sulphur diesel fuel.

In addition to being used as an engine fuel, the low-sulphur fuel can also be used as a reducing agent for deNOx catalytic converters in lean exhaust gas.

A further application for the low-sulphur fuel obtained using the process according to the invention is its use in the desulfurization of a catalytic converter in an exhaust-gas after-treatment system of an engine. In the exhaust-gas after-treatment system, from time to time sulphur accumulates on the surface of the catalytic converter and is removed by regeneration (desorption). This can only take place with low-sulphur exhaust gas.

The outlay on equipment for carrying out the process according to the invention is low. Consequently, it is also possible for the overall volume and weight to be kept low. The process according to the invention is therefore suitable for use in all mobile systems, such as passenger or commercial vehicles or in rail-borne vehicles.

A further advantage of the process according to the invention is that the low-sulphur fuel fraction is available onboard as soon as the engine is started. It is therefore possible to dispense with an additional storage tank for low-sulphur fuel specifically for the cold-start phase.

The low-sulphur fuel obtained can either be utilized immediately or can be stored in a tank.

The process according to the invention can be used for all engine fuels, in particular petrol or diesel fuels, kerosine or methanol.

The invention is explained in more detail with reference to drawings.

DETAILED DESCRIPTION OF THE DRAWINGS

Figure 1:
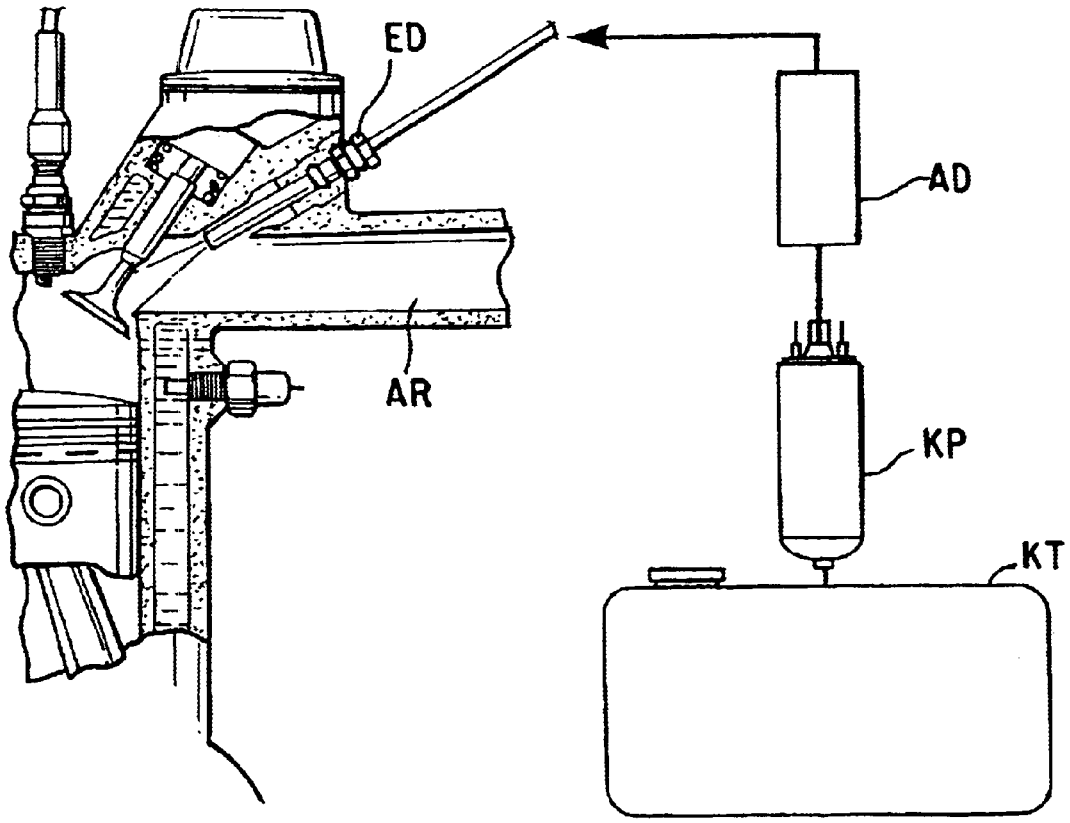
FIG. 1 shows a first structure for carrying out the process according to the invention.
Figure 2:
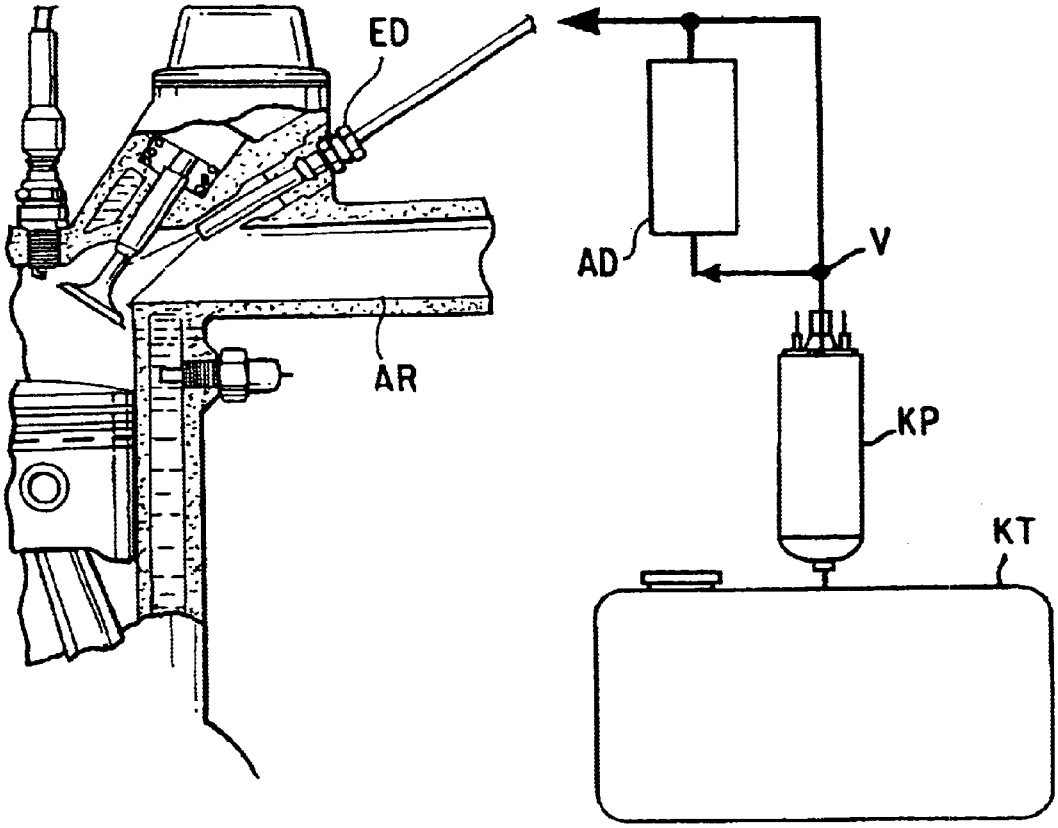
FIG. 2 shows a second structure for carrying out the process according to the invention.

The adsorption device may be connected in series downstream of the fuel pump (FIG. 1) or as a bypass to the normal fuel supply (FIG. 2).

FIG. 1 shows an arrangement with the fuel pump and adsorption device arranged in series. The fuel is removed from the fuel tank KT by means of electrical fuel pump KP and then passes through the adsorption device AD according to the invention before being fed to the engine via the injection nozzle ED. The intake pipe of the engine is denoted by AR. In the series circuit illustrated here, all the fuel supplied to the engine is desulphurized.

In the case of the bypass circuit, it is possible to switch between the normal branch, without the adsorption device, and the branch with the adsorption device, by means of a valve V. In this way, it is possible to employ the desulfurization only in certain operating phases of the engine. For example, the desulfurization can be included in a controlled manner only when the engine is in lean-burn mode and during desulfurization of the adsorber catalytic converter contained in the exhaust-gas after-treatment system. The bypass circuit illustrated allows the running capacity of the adsorption device to be increased or allows the adsorption device to be of smaller design.

Figure 3:
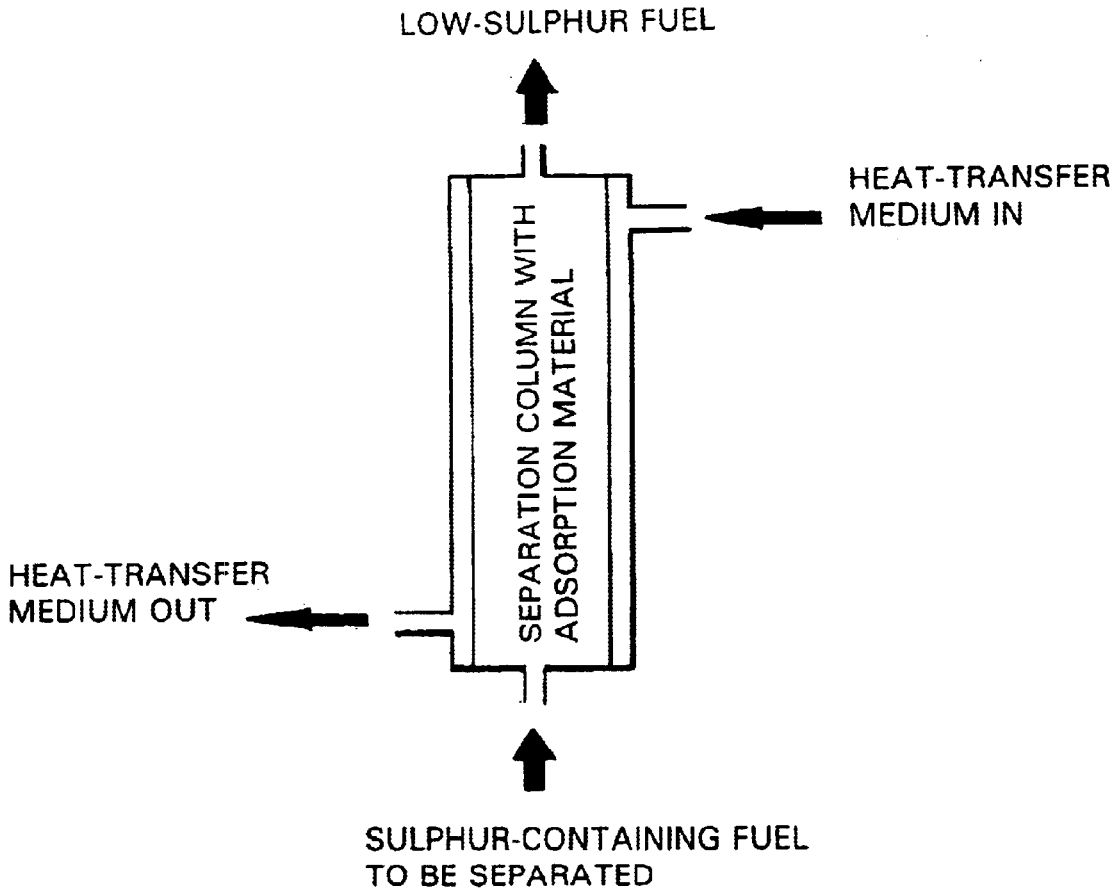
FIG. 3 shows an adsorption device for carrying out the process according to the invention.

FIG. 3 diagrammatically depicts an adsorption device in the form of a separating column, the interior of which is filled by the adsorption material. The sulphur-containing fuel mixture to be separated is introduced undiluted into the inlet of the separating column and is passed to the adsorption material. The sulphur-containing fuel components are selectively adsorbed on the adsorption material. The sulphur-free (generally low-boiling) fuel components which have not been adsorbed leave the separation column at the opposite end as the eluate. The separation column is surrounded by an annular channel through which a heat-transfer medium flows in order to control the temperature of the separation column.

Figure 4:
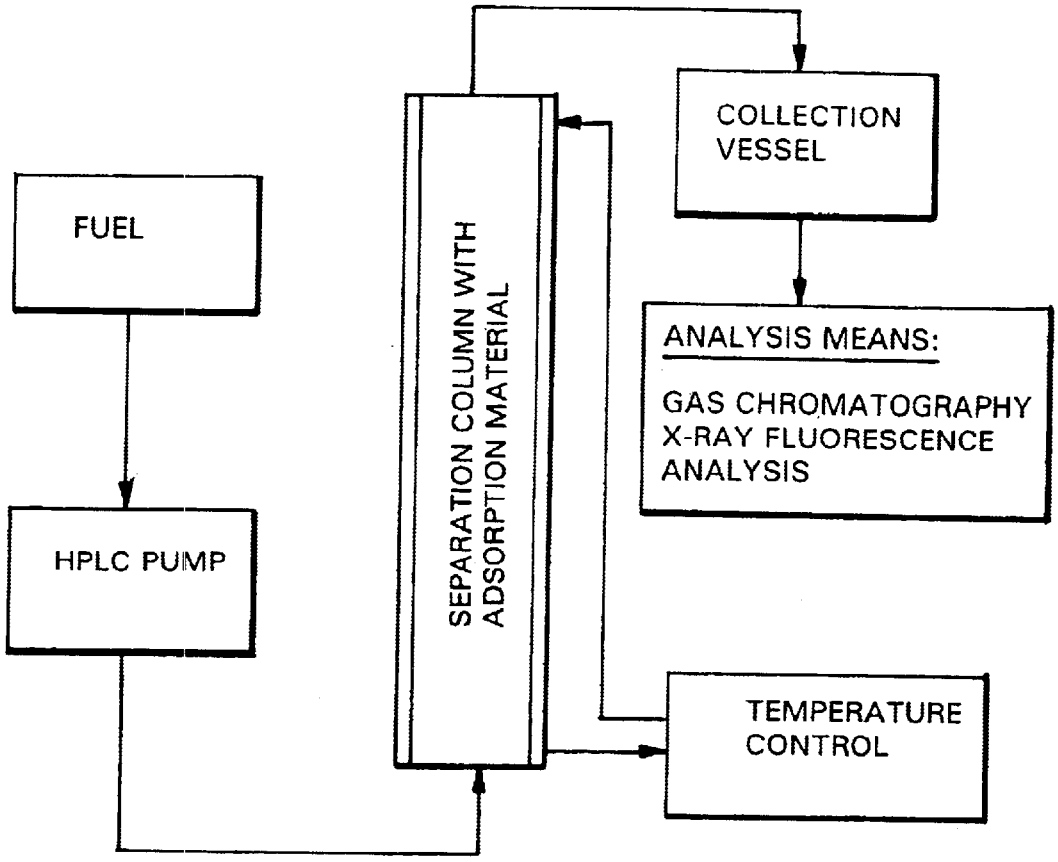
FIG. 4 shows a test structure for determining the adsorber properties and adsorber capacity.

FIG. 4 shows the test structure for determining the adsorber properties and the adsorber capacity. The fuel is removed from a storage vessel and is passed through the temperature-controlled adsorption column by means of a HPLC pump (max. throughput 10 ml/min). For quantitative analysis, the eluate can be analysed off-line by means of gas chromatography and X-ray fluorescence analysis.

Figure 5:
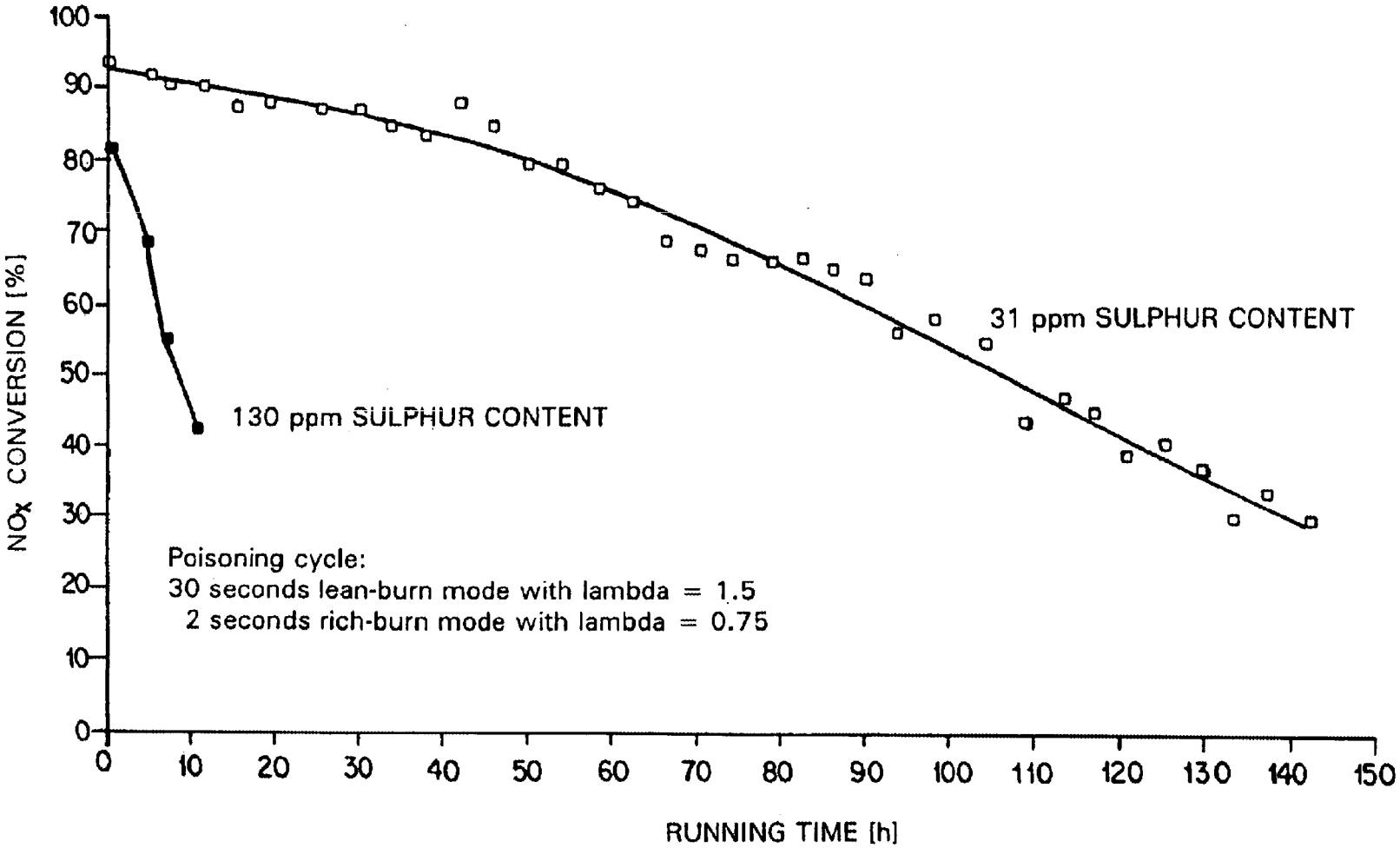
FIG. 5 shows the effect of the fuel sulfur content on the $NO_x$ conversion of an exhaust-gas after-treatment system.

FIG. 5 shows the effect of the sulphur content of the fuel on the $NO_x$ conversion of an exhaust-gas after-treatment system. The operating duration (in hours) is plotted on the abscissa, and the $NO_x$ conversion (in #) is plotted on the ordinate. Two series of measurements were recorded for sulphur contents of 31 ppm and 130 ppm, with the same type of catalyst c converter. True tests were carried cut using a direct-injection spark-ignition engine in mixed lean-burn mode (30 seconds of lean-burn mode with $\lambda$=1.5 and 2 seconds of rich-burn mode with $\lambda$=0.75). As can be seen from the comparison of the measurement series, the service life of the catalytic converter falls drastically with a high sulphur content.

What is claimed is:

1. A process for the desulfurization of an engine fuel onboard a motor vehicle, comprising:

contacting an engine fuel comprising sulfur-containing components with a selective liquid-phase adsorption material comprising an oxide of Al, Mg, Si, or Ti that is doped with Ag; and separating the sulfur-containing components from the engine fuel, thereby obtaining a low-sulfur fuel; and using the low-sulfur fuel for a spark-ignition engine or a diesel engine.

2. A process according to claim 1, wherein the adsorption material has an internal surface area of from 10 to 1600 $m^2/g$.

3. A process according to claim 1, wherein the adsorption material comprises at least one of $Al_2O_3$, MgO, $SiO_2$, or $TiO_2$.

4. A process according to claim 1, wherein the adsorption material comprises zeolites, hydrotalcites, or mixed oxides doped with Ag.

5. A process according to claim 1, wherein the engine fuel is selected from the group consisting of petrol, diesel fuel, kerosine, and methanol.

6. A process according to claim 1, further comprising collecting the low-sulphur fuel in a tank.

7. A process according to claim 1, further comprising immediately using the low-sulfur fuel.

8. A process according to claim 1, wherein the adsorption material is arranged in series with a fuel pump.

9. A process according to claim 1, further comprising regenerating a sulfur-containing adsorption material onboard the motor vehicle.

10. A process according to claim 1, further comprising replacing a sulfur-containing adsorption material.

11. A process for the desulfurization of an engine fuel onboard a motor vehicle, comprising:

contacting an engine fuel comprising sulfur-containing components with a selective liquid-phase adsorption material, wherein the adsorption material is a biogenic material; and separating the sulfur-containing components from the engine fuel, thereby obtaining a low-sulfur fuel.

12. A process according to claim 11, wherein the biogenic material is an enzyme.

13. A process for the desulfurization of an engine fuel onboard a motor vehicle, comprising:

contacting an engine fuel comprising sulfur-containing components with a selective liquid-phase adsorption material comprising an oxide of Al, Mg, Si, or Ti that is doped with Ag; and separating the sulfur-containing components from the engine fuel, thereby obtaining a low-sulfur fuel for use by the motor vehicle, wherein the adsorption material is arranged in a bypass circuit of a fuel pump.

14. A process for the desulfurization of an engine fuel onboard a motor vehicle, comprising:

contacting an engine fuel comprising sulfur-containing components with a selective liquid-phase adsorption material comprising an oxide of Al, Mg, Si, or Ti that is doped with Ag; and separating the sulfur-containing components from the engine fuel, thereby obtaining a low-sulfur fuel for use by the motor vehicle, wherein the adsorption material is integrated in a single structural unit with a fuel filter.

15. A process for the desulfurization of an engine fuel onboard a motor vehicle, comprising:

contacting an engine fuel comprising sulfur-containing components with a selective liquid-phase adsorption material comprising an oxide of Al, Mg, Si, or Ti that is doped with Ag;

separating the sulfur-containing components from the engine fuel, thereby obtaining a low-sulfur fuel for use by the motor vehicle; and regenerating a sulfur-containing adsorption material onboard the motor vehicle, wherein the regenerating comprises heating the sulfur-containing adsorption material with the engine oil or the engine coolant of the motor vehicle.

16. A process for removing nitrogen oxides from a lean exhaust gas, comprising:

contacting the low-sulfur fuel according to claim 1 with a catalytic converter; and removing nitrogen oxides from the lean exhaust gas by using the low-sulfur fuel as a reducing agent.

17. A process for desulfurizing a catalytic converter in an exhaust-gas after-treatment engine system, comprising contacting an engine fuel comprising sulfur-containing components with a selective liquid-phase adsorption material comprising an oxide of Al, Mg, Si, or Ti that is doped with Ag;

separating the sulfur-containing components from the engine fuel, thereby obtaining a low-sulfur fuel for use by the motor vehicle; and desorbing accumulated sulfur from the catalytic converter using the low-sulfur fuel.

18. A process for desulfurizing a fuel and using desulfurized fuel for a motor vehicle, the process comprising:

using an adsorption unit to reduce the sulfur content of a fuel, wherein the adsorption unit is placed onboard the motor vehicle; and regenerating the adsorption unit using heat from engine coolant or engine oil.

19. A process according to claim 18, wherein the adsorption unit has an adsorption material that has an internal surface area of from 10 to 1600 $m^2g$.

20. A process for desulfurizing a fuel and using desulfurized fuel for a motor vehicle, the process comprising:

using an adsorption unit to reduce the sulfur content of a fuel, wherein the motor vehicle has a main fuel line and a bypass fuel line in parallel with the main fuel line, and wherein the adsorption unit is placed in the bypass fuel line; and using the fuel of reduced sulfur content as engine fuel only when the engine is in a lean-burn mode.

21. A process according to claim 20, wherein the adsorption unit has an adsorption material that has an internal surface area of from 10 to 1600 $m^2g$.

22. A process according to claim 20, further comprising regenerating the adsorption unit using beat from engine coolant or engine oil.

23. A process for desulfurizing a fuel and using desulfurized fuel for a motor vehicle, the process comprising:

using an adsorption unit to reduce the sulfur content of a fuel, wherein the adsorption unit is placed onboard the motor vehicle; and using the fuel of reduced sulfur content as a reducing agent for deNOxing a catalytic converter of the motor vehicle.

24. A process according to claim 23, wherein the adsorption unit has an adsorption material that has an internal surface area of from 10 to 1600 $m^2g$.

25. A process according to claim 23, further comprising regenerating the adsorption unit using heat from engine coolant or engine oil.

26. A process according to claim 25, further comprising using the fuel of reduced sulfur content as engine fuel only when the engine is in a lean-burn mode, wherein the motor vehicle has a main fuel line and a bypass fuel line in parallel with the main fuel line, and wherein the adsorption unit is placed in the bypass fuel line.

27. A process for desulfurizing a fuel and using desulfurized fuel for a motor vehicle, the process comprising:

using an adsorption unit to reduce the sulfur content of a fuel, wherein the adsorption unit is placed onboard the motor vehicle; and using the fuel of reduced sulfur content to desulfurize a catalytic converter in an exhaust gas after-treatment system.

28. A process according to claim 27, wherein the adsorption unit has an adsorption material that has an internal surface area of from 10 to 1600 $m^2g$.

29. A process according to claim 27, further comprising regenerating the adsorption unit using heat from engine coolant or engine oil.

30. A process according to claim 29, further comprising using the fuel of reduced sulfur content as engine fuel only when the engine is in a lean-burn mode, wherein the motor vehicle has a main fuel line and a bypass fuel line in parallel with the main fuel line, and wherein the adsorption unit is placed in the bypass fuel line.

31. A process according to claim 30, further comprising using the fuel of reduced sulfur content as a reducing agent for deNOxing a catalytic converter of the motor vehicle.

32. A process for the desulfurization of an engine fuel onboard a motor vehicle, comprising:

contacting an engine fuel comprising sulfur-containing components with a selective liquid-phase adsorption material, wherein the adsorption material comprises a microorganism; and separating the sulfur-containing components from the engine fuel, thereby obtaining a low-sulfur fuel.

33. A process according to claim 32, wherein the microorganism is a bacterium.

* * * * *